US011608571B2

(12) United States Patent
Meinders et al.

(10) Patent No.: US 11,608,571 B2
(45) Date of Patent: Mar. 21, 2023

(54) TRILOBAL FILAMENTS AND SPINNERETS FOR PRODUCING THE SAME

(71) Applicant: Aladdin Manufacturing Corporation, Calhoun, GA (US)

(72) Inventors: Maarten Meinders, Dalton, GA (US); Paul Pustolski, Newark, DE (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 678 days.

(21) Appl. No.: 16/430,411

(22) Filed: Jun. 3, 2019

(65) Prior Publication Data

US 2019/0284723 A1 Sep. 19, 2019

Related U.S. Application Data

(62) Division of application No. 15/488,825, filed on Apr. 17, 2017.

(60) Provisional application No. 62/376,698, filed on Aug. 18, 2016.

(51) Int. Cl.

| | |
|---|---|
| ***D01D 5/253*** | (2006.01) |
| ***D01D 5/24*** | (2006.01) |
| *D01F 6/60* | (2006.01) |

(52) U.S. Cl.

CPC ..... *D01D 5/253* (2013.01); *D01D 5/24* (2013.01); *D01F 6/60* (2013.01)

(58) Field of Classification Search

None

See application file for complete search history.

(56) References Cited

U.S. PATENT DOCUMENTS

| | | | |
|---|---|---|---|
| 3,419,936 | A | 1/1969 | Sims |
| 3,493,459 | A | 2/1970 | McIntosh et al. |
| 3,558,420 | A | 1/1971 | Opfell et al. |
| 3,772,137 | A | 11/1973 | Tolliver |
| 4,110,965 | A | 9/1978 | Bradley et al. |
| 4,279,053 | A | 7/1981 | Payne et al. |
| 4,383,817 | A | 5/1983 | Mirhej et al. |

(Continued)

FOREIGN PATENT DOCUMENTS

| | | |
|---|---|---|
| EP | 0601372 A1 | 6/1994 |
| EP | 625219 B1 | 2/1998 |

OTHER PUBLICATIONS

Non-Final Office Action issued in U.S. Appl. No. 15/488,825, dated Feb. 21, 2020.

(Continued)

*Primary Examiner* — Marla D McConnell
*Assistant Examiner* — Kevin Worrell
(74) *Attorney, Agent, or Firm* — Meunier Carlin & Curfman LLC

(57) ABSTRACT

Various implementations include a filament that includes three lobes that extend from a central portion of the filament, and the central portion defines an axial void. Each lobe bulges outwardly at its proximal end adjacent the central portion and has edges that form a continuous concave curve toward its distal end relative to an axis A-A that extends through the distal end of the respective lobe and the central portion of the filament. Thus, a width of each lobe at the proximal end thereof is greater than a width of each lobe at or adjacent the distal end, and adjacent edges of adjacent lobes intersect each other at concave proximal ends of the adjacent edges.

4 Claims, 5 Drawing Sheets

(56) References Cited

U.S. PATENT DOCUMENTS

| | | | |
|---|---|---|---|
| 4,398,933 | A | 8/1983 | Lecron et al. |
| 4,648,830 | A | 3/1987 | Peterson et al. |
| 4,770,938 | A | 9/1988 | Morrison et al. |
| 5,108,838 | A | 4/1992 | Tung et al. |
| 5,125,818 | A | 6/1992 | Yeh et al. |
| 5,154,908 | A | 10/1992 | Edie et al. |
| 5,190,821 | A | 3/1993 | Jackson et al. |
| 5,208,106 | A | 5/1993 | Tung et al. |
| 5,208,107 | A | 5/1993 | Yeh et al. |
| 5,230,957 | A | 7/1993 | Lin et al. |
| 5,279,897 | A | 1/1994 | Jackson et al. |
| 5,322,736 | A | 6/1994 | Peterson et al. |
| 5,362,563 | A | 11/1994 | Lin et al. |
| 5,380,592 | A | 1/1995 | Tung et al. |
| 5,413,857 | A | 5/1995 | Li et al. |
| 5,462,802 | A | 10/1995 | Tajiri et al. |
| 5,486,417 | A | 1/1996 | Hagen et al. |
| 5,489,475 | A | 2/1996 | Hagen et al. |
| 5,512,367 | A | 4/1996 | Hagen et al. |
| 5,523,155 | A | 6/1996 | Lin et al. |
| 5,540,993 | A | 7/1996 | Hernandez et al. |
| 5,587,118 | A | 12/1996 | Mallonee et al. |
| 5,597,650 | A | 1/1997 | Mallonee et al. |
| 5,620,797 | A | 4/1997 | Mallonee et al. |
| 5,686,121 | A | 11/1997 | Samuelson et al. |
| D410,554 | S | 6/1999 | Guyton |
| 5,922,462 | A | 7/1999 | Kent et al. |
| 5,932,346 | A | 8/1999 | Kent et al. |
| 5,948,528 | A | 9/1999 | Helms, Jr. et al. |
| 5,985,193 | A | 11/1999 | Newport et al. |
| 6,017,478 | A | 1/2000 | Kent et al. |
| D422,099 | S | 3/2000 | Kracke |
| 6,048,615 | A | 4/2000 | Lin et al. |
| 6,153,138 | A | 11/2000 | Helms, Jr. et al. |
| 6,162,382 | A | 12/2000 | Kent et al. |
| 6,395,392 | B1 | 5/2002 | Gownder et al. |
| 6,458,726 | B1 | 10/2002 | Harrington et al. |
| 6,589,653 | B2 | 7/2003 | Lin |
| 6,620,505 | B1 | 9/2003 | Koyanagi et al. |
| 6,652,965 | B2 | 11/2003 | Merigold et al. |
| 6,660,377 | B2 | 12/2003 | Bernaschek |
| 6,673,442 | B2 | 1/2004 | Johnson et al. |
| 6,673,450 | B2 | 1/2004 | Portus et al. |
| 6,740,401 | B1 | 5/2004 | Nishimura et al. |
| 6,803,102 | B1 | 10/2004 | Haggard et al. |
| 6,939,608 | B2 | 9/2005 | Tung |
| 6,958,188 | B2 | 10/2005 | Moorhead et al. |
| 7,028,695 | B2 | 4/2006 | Montoli et al. |
| 7,087,303 | B2 | 8/2006 | Tung |
| D549,360 | S | 8/2007 | An |
| D550,864 | S | 9/2007 | Emerling et al. |
| 7,883,772 | B2 | 2/2011 | Sharp et al. |
| 7,968,480 | B2 | 6/2011 | Delattre et al. |
| 7,981,226 | B2 | 7/2011 | Sharp et al. |
| 7,998,577 | B2 | 8/2011 | Yost et al. |
| 8,043,689 | B2 | 10/2011 | Weiser et al. |
| 8,137,811 | B2 | 3/2012 | Dugan et al. |
| 8,297,035 | B2 | 10/2012 | Tachibana et al. |
| 8,420,556 | B2 | 4/2013 | Sharp et al. |
| D689,215 | S | 9/2013 | Xue |
| 2003/0096114 | A1 | 5/2003 | Chen et al. |
| 2003/0119403 | A1 | 6/2003 | Willis et al. |
| 2004/0147194 | A1 | 7/2004 | Willis et al. |
| 2004/0170836 | A1 | 9/2004 | Bond et al. |
| 2005/0112373 | A1 | 5/2005 | Tung |
| 2006/0008548 | A1* | 1/2006 | Tung ..... D01D 5/24 425/72.2 |
| 2007/0077427 | A1 | 4/2007 | Dugan et al. |
| 2007/0128404 | A1 | 6/2007 | Tung et al. |
| 2007/0207317 | A1 | 9/2007 | Willingham et al. |
| 2008/0032579 | A1 | 2/2008 | Abed et al. |
| 2010/0029161 | A1 | 2/2010 | Pourdeyhimi |
| 2010/0159186 | A1 | 6/2010 | Samuelson et al. |
| 2011/0281057 | A1 | 11/2011 | Tung et al. |
| 2011/0287210 | A1 | 11/2011 | Tung et al. |
| 2012/0128437 | A1 | 5/2012 | Weiser et al. |
| 2012/0231207 | A1 | 9/2012 | Rock et al. |
| 2012/0231690 | A1 | 9/2012 | Pourdeyhimi et al. |
| 2012/0238982 | A1 | 9/2012 | Weisman |
| 2012/0289107 | A1 | 11/2012 | Beissinger et al. |
| 2013/0029086 | A1 | 1/2013 | Samuelson et al. |
| 2013/0029152 | A1 | 1/2013 | Samuelson et al. |
| 2013/0059495 | A1 | 3/2013 | Dempster et al. |
| 2013/0344331 | A1 | 12/2013 | Corn et al. |
| 2014/0103556 | A1 | 4/2014 | Diaz de leon Izquierdo et al. |
| 2015/0275400 | A1 | 10/2015 | Tung et al. |

OTHER PUBLICATIONS

Non-Final Office Action issued in U.S. Appl. No. 15/488,825, dated Dec. 23, 2020.

Final Office Action in U.S. Appl. No. 15/488,825, dated Aug. 16, 2021 (10 pages).

Office Action in U.S. Appl. No. 15/488,825, dated Feb. 8, 2019 (9 pages).

Office Action in U.S. Appl. No. 15/488,825, dated Aug. 22, 2019 (11 pages).

Non-final Office Action issued in Design U.S. Appl. No. 29/583,406, dated Mar. 26, 2018.

Non-Final Office Action in connection to U.S. Appl. No. 15/488,825, dated Mar. 29, 2022.

Interview Summary in connection to U.S. Appl. No. 15/488,825, dated Mar. 10, 2022.

Advisory Action issued in co-pending U.S. Appl. No. 15/488,825, dated Nov. 29, 2019.

Final Office Action issued in U.S. Appl. No. 15/488,825, dated Jun. 26, 2020.

* cited by examiner

TRILOBAL FILAMENTS AND SPINNERETS FOR PRODUCING THE SAME

CROSS REFERENCE TO RELATED APPLICATIONS

This application is a divisional of U.S. application Ser. No. 15/488,825, filed Apr. 17, 2017 entitled "Trilobal Filaments and Spinnerets for Producing the Same," which claims priority to U.S. Provisional Patent Application No. 62/376,698, filed Aug. 18, 2016, entitled "Trilobal Filaments and Spinnerets for Producing the Same," which are herein incorporated by reference in their entireties.

BACKGROUND

FIG. 1 illustrates a prior art filament that has been used for soil hiding. The filament shown in FIG. 1 includes four holes and is square shaped. The holes refract light passing through the filament, which helps to hide dirt, but the luster of the filament dulls over time and looks chalky when exposed to higher temperatures.

Thus, there is a need in the art for an improved filament that has soil hiding properties and is robust.

BRIEF SUMMARY

Various implementations include a filament formed from a thermoplastic polymer. The filament includes three lobes that extend from a central portion of the filament, and each lobe has a proximal end adjacent the central portion and a distal end radially spaced apart from the proximal end. The edges of each lobe between the proximal end and the distal end thereof define a continuous concave curve relative to an axis extending through the distal end of the respective lobe and the central portion of the filament. A width of each lobe is greatest at the proximal end thereof. Adjacent edges of adjacent lobes intersect each other at concave proximal ends of the adjacent edges, and the central portion defines an axial void.

In certain implementations, the void can be round or triangular. For example, in some implementations having a triangular shaped void, the void has concave shaped sides relative to a central axis extending axially through the void. In addition, in some implementations having a triangular shaped void, the vertices of the void extend toward the intersections of the adjacent edges of adjacent lobes.

In some implementations, lines tangential to adjacent edges of adjacent lobes at the proximal ends of the adjacent edges intersect at an angle of between 120° and 180°.

In some implementations, a line tangential to the tip of each lobe adjacent the distal end of the respective lobe and a line perpendicular to the axis extending through the distal end of the respective lobe and the central portion of the filament intersect at an angle of between 0° and 45°.

In some implementations, the filament has a first radius R1 that extends from a central axis of the filament to a geometric center of the distal end of one of the lobes and a second radius R2 that extends from the central axis of the filament to the intersection of adjacent edges of two adjacent lobes, and a ratio of the first radius R1 to the second radius R2 defines an external modification ratio (R1/R2) of between 2.0 and 2.5. In certain implementations, each distal end of each lobe has a tip radius R3, and a ratio of the first radius R1 to the tip radius R3 defines a first tip ratio (R1/R3) of between 0.17 and 0.27. And, in some implementations, a ratio of the second radius R2 to the tip radius R3 defines a second tip ratio (R2/R3) of between 0.4 and 0.6.

In some implementations, an area of the void is 2% to 3.5% of a cross-sectional area of the filament.

In some implementations, a modification ratio of the void is between 1.0 and 2.0.

In some implementations, the filament is 24 denier per filament.

In some implementations, the thermoplastic polymer comprises Nylon 6.

In some implementations, the relative viscosity of Nylon 6 is between 2.4 and 3.6.

Other implementations include a spinneret plate for producing filament. The spinneret plate includes one or more capillaries, and each capillary includes a substantially hexagonal shaped central area, an outer radial area that is radially spaced apart from the substantially hexagonal shaped central area, and legs that extend between the outer radial area and the substantially hexagonal shaped central area. The capillary defines three openings, and each opening is defined between the substantially hexagonal shaped central area, the outer radial area, and two adjacent legs. Each opening has a proximal end adjacent the substantially hexagonal shaped central area and a distal end adjacent the outer radial area, and the proximal end has a greater width than the distal end such that each opening has a substantially triangular shape.

In some implementations, the proximal end of each opening has a geometric center defined by an intersection of two adjacent sides of the substantially hexagonal shaped central area adjacent the opening.

In some implementations, the distal end of each opening has a rounded tip.

BRIEF DESCRIPTION OF THE DRAWINGS

Various implementations are explained in even greater detail in the following exemplary drawings. The drawings are merely exemplary to illustrate the structure of various devices and certain features that may be used singularly or in combination with other features. The invention should not be limited to the implementations shown.

DETAILED DESCRIPTION

Various implementations include a thermoplastic polymer filament that provides improved soil hiding without dulling the luster of the filament. In addition, the filament maintains its color over a wide temperature range and is durable. Such a filament may be useful in carpets or textiles, for example. In addition, various implementations include a spinneret plate that defines one or more capillaries for producing the filament.

Figure 2:
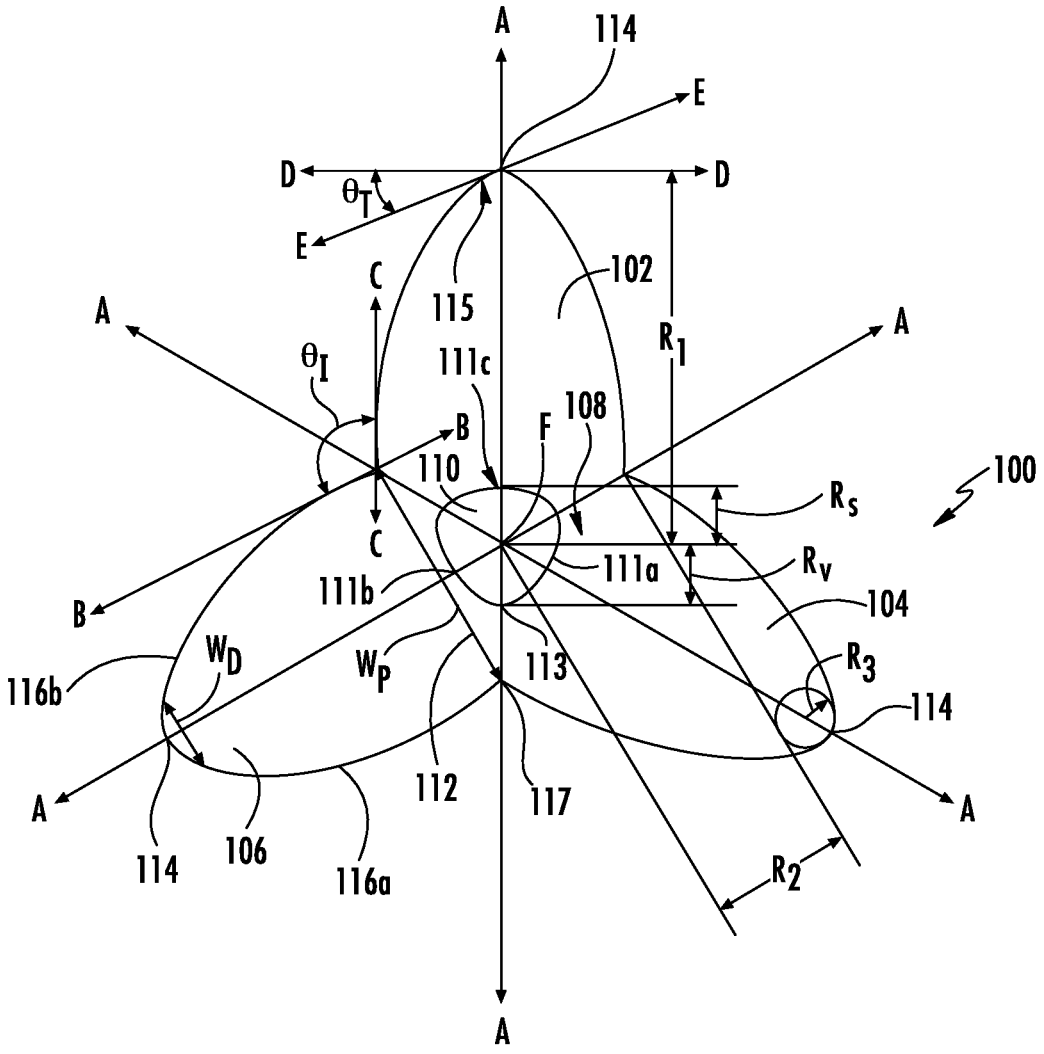
FIG. 2 illustrates an end view of a filament according to one implementation.

For example, FIG. 2 illustrates one implementation of a filament 100. The filament 100 includes three lobes 102, 104, 106 that extend from a central portion 108 of the filament 100, and the central portion 108 defines an axial void 110. Each lobe 102, 104, 106 bulges outwardly at its proximal end 112 adjacent the central portion 108 and has edges 116*a*, 116*b* that form a continuous concave curve toward its distal end 114 relative to an axis A-A that extends through the distal end 114 of the respective lobe 102, 104, 106 and the central portion 108 of the filament 100. Thus, a width $W_p$ of each lobe 102, 104, 106 at the proximal end 112 thereof is greater than a $W_D$ at or adjacent the distal end 114, and adjacent edges 116*a*, 116*b* of adjacent lobes intersect each other at concave proximal ends 117 of the adjacent edges 116*a*, 116*b*.

In addition, line B-B is tangential to edge 116*b* of lobe 106 at the proximal end 117 of the edge 116*b*, and line C-C is tangential to edge 116*a* of lobe 102 at the proximal end 117 of the edge 116*a*. Edge 116*b* of lobe 106 is adjacent edge 116*a* of lobe 102, and lines B-B and C-C intersect at an angle $\Theta_I$ of 120°. However, in other implementations, $\Theta_I$ is between 120° and 180°.

In addition, line D-D is perpendicular to the axis A-A that extends through the distal end 114 of lobe 102 and the central portion 108, and line E-E is tangential to a portion 115 of a tip portion of the lobe 102 adjacent the distal end 114 of lobe 102. Lines D-D and E-E intersect at an angle $\Theta_T$ of 30°. However, in other implementations, $\Theta_T$ is between 0° and 45°.

Furthermore, in the implementation shown in FIG. 2, the distal end 114 of each lobe is aligned with the intersection 117 of the other two lobes. In particular, line A-A extending through the distal end 114 of lobe 102 and central portion 108 extends through the intersection 117 of the adjacent edges 116*a*, 116*b* of adjacent lobes 104 and 106. Similarly, line A-A extending through the distal end 114 of lobe 104 and central portion 108 extends through the intersection 117 of adjacent edges 116*a*, 116*b* of adjacent lobes 102 and 106. And, line A-A extending through the distal end 114 of lobe 106 and central portion 108 extends through the intersection 117 of adjacent edges 116*a*, 116*b* of adjacent lobes 102 and 104. However, in other implementations, the lobes may not be equispaced about the central portion.

The filament 100 also has a radius R1 that extends from the central axis F of the filament 100 to the distal end 114 of any one of the lobes 102, 104, 106 and a second radius R2 that extends from the central axis F to the intersection of adjacent edges 116*a*, 116*b* of any two adjacent lobes 102, 104, 106. A ratio of the radius R1 to the radius R2 defines an external modification ratio (R1/R2) of between 2.0 and 2.5. For example, in one implementation, the external modification ratio is 2.2. In addition, each distal end 114 has a tip radius R3, and a ratio of the radius R1 to the tip radius R3 defines a first tip ratio (R1/R3) of between 0.17 and 0.27 (e.g., 0.21). A ratio of the radius R2 to the tip radius R3 defines a second tip ratio (R2/R3) of between 0.4 and 0.6 (e.g., 0.55).

In other implementations, the tip portion adjacent the distal end 114 of each lobe is non-circular shaped.

Figure 1:
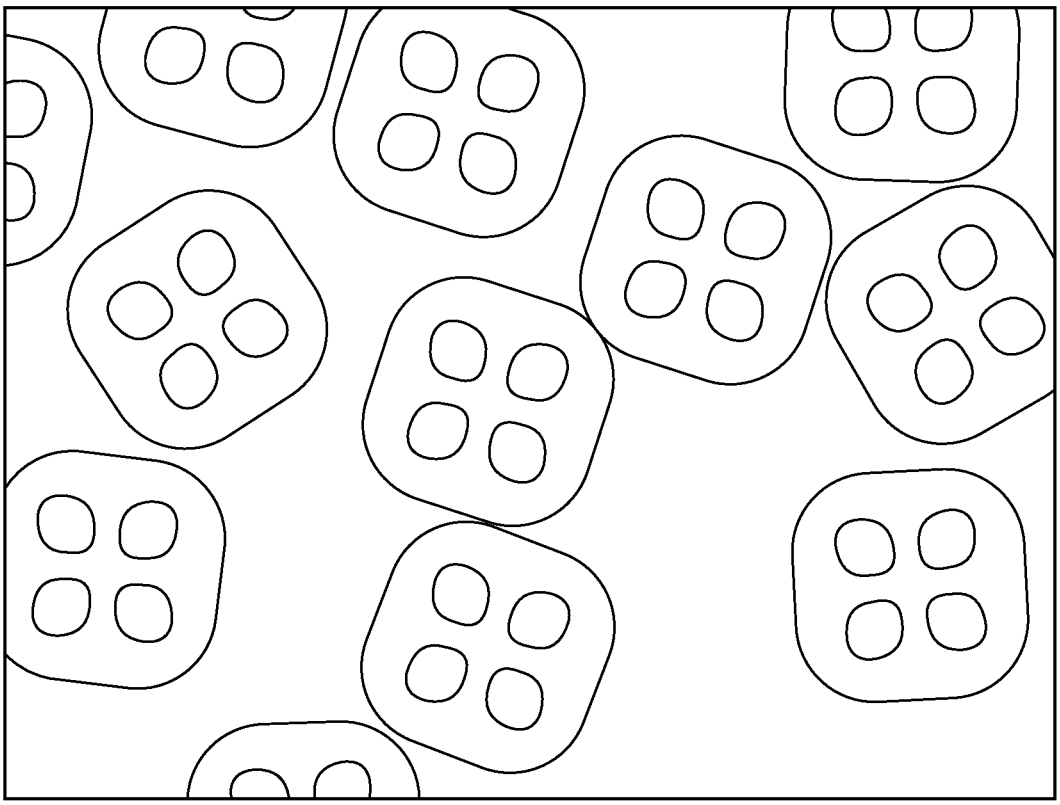
FIG. 1 PRIOR ART
FIG. 1 illustrates an end view of a filament in the prior art.

The void 110 shown in FIG. 1 has three concave shaped sides 111*a*, 111*b*, 111*c* relative to the central axis F that extends axially through the void 110. The sides 111*a-c* define an acorn or bulging triangular shape. In addition, vertices 113 of the void 110 are defined by each pair of intersecting sides 111*a*-111*c*, and each vertex 113 is aligned with the intersection 117 of the adjacent edges 116*a*, 116*b* of adjacent lobes 102, 104, 106 that is nearest the respective vertex 113 and the central axis F. In other implementations, the void 110 is round or triangular.

According to some implementations, an area of the void 110 is 2% to 3.5% of a cross sectional area of the filament 100. And, a modification ratio of the radius $R_V$ from the central axis F to one of the vertices 113 to the radius $R_S$ from the central axis F to a midpoint of one of the sides 111*a-c* ($R_V/R_S$) is between 1.0 and 2.0 (e.g., 1.5 to 2.0).

According to some implementations, the void 110 causes light to scatter when passing through the filament 100, which helps with hiding soil. In addition, the low external modification ratio of R1/R2 provides less surface area to which soil can cling and is durable.

Figure 3:
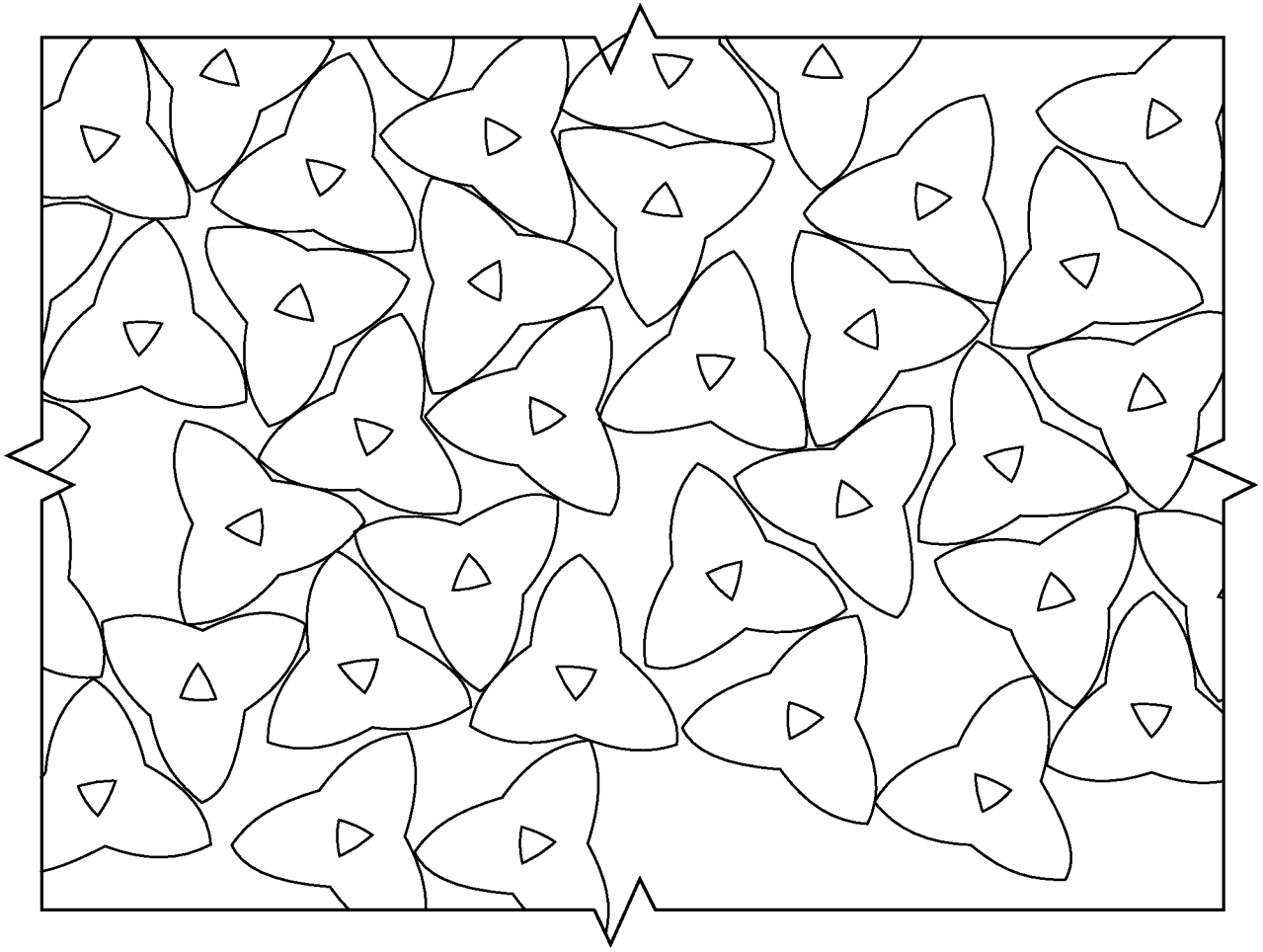
FIG. 3 illustrates an end view of a plurality of filaments, such as the filament shown in FIG. 2.

The thermoplastic polymer used to produce the filament 100 in FIGS. 2 and 3 includes Nylon 6, but other suitable thermoplastic polymers may be used in other implementations. For example, other exemplary polymers include Nylon 6,6, polyethylene terephthalate (PET), and polytrimethylene terephthalate (PTT). The relative viscosity of the nylon 6 is between 2.4 and 3.6. The filament 100 is at least 24 denier, but other implementations may have various other suitable deniers.

Figure 4:
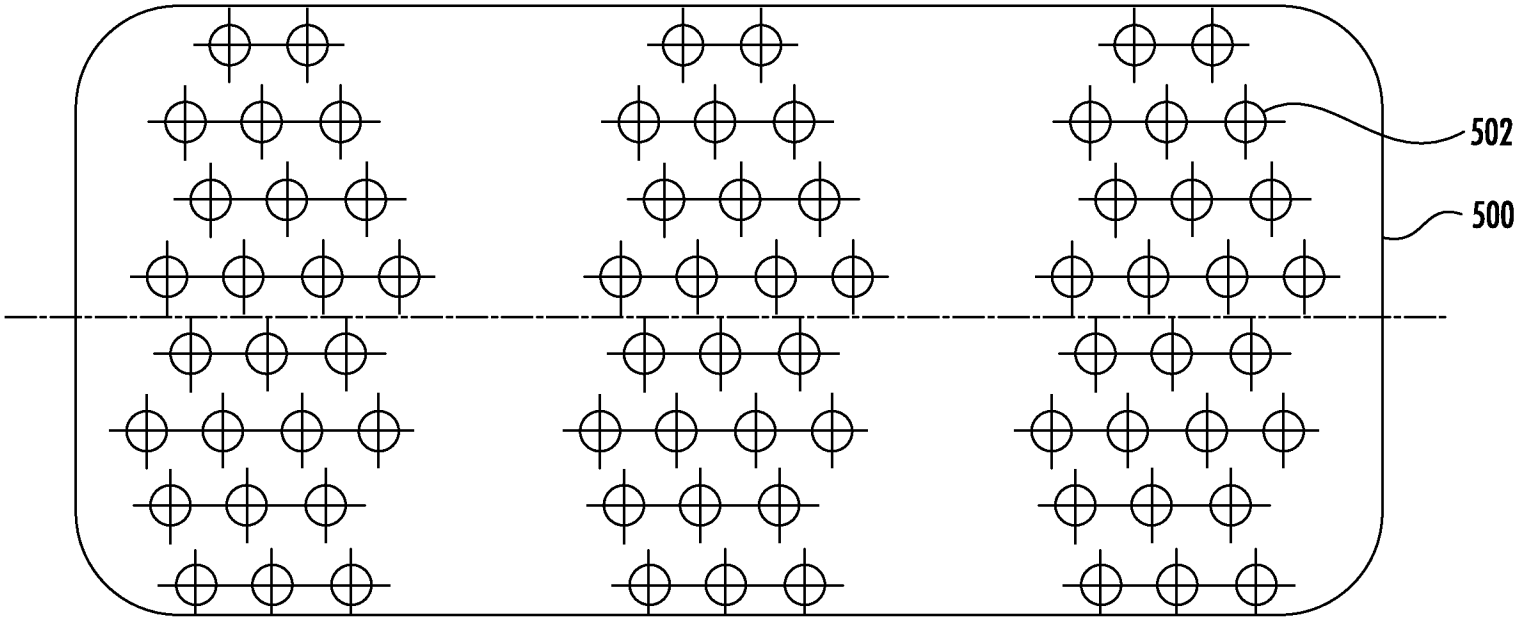
FIG. 4 illustrates a spinneret plate having a plurality of capillaries according to one implementation.
Figure 5:
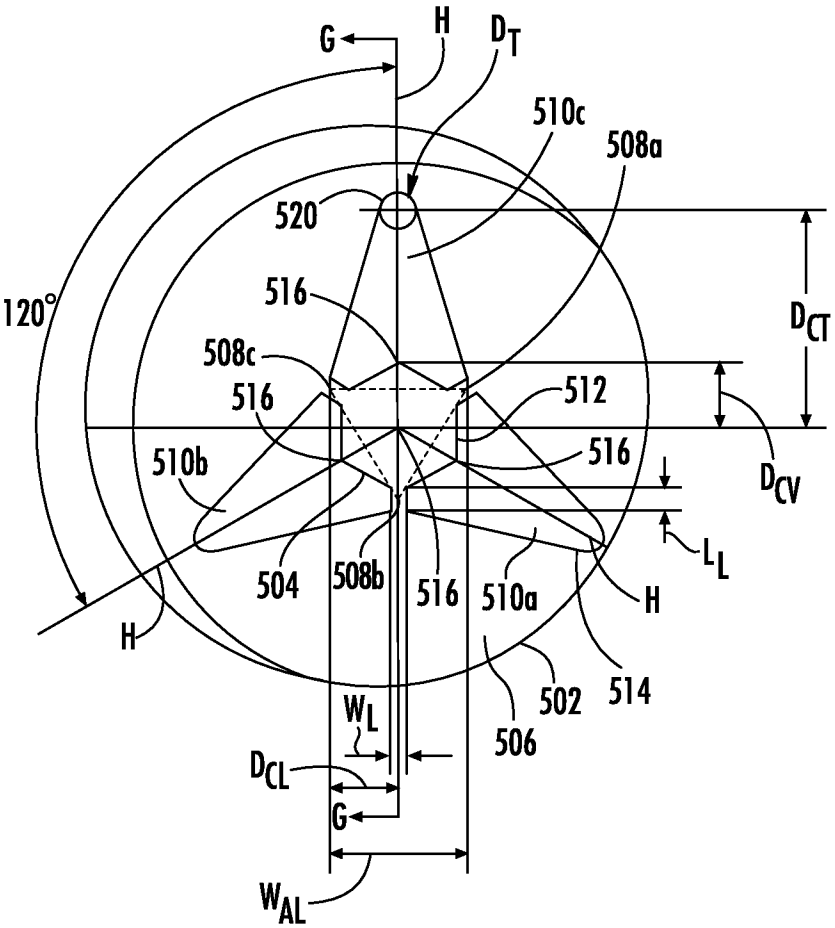
FIG. 5 illustrates an end view of one of the capillaries of the spinneret plate of FIG. 4.

Various implementations also include a spinneret plate for producing filament. FIG. 4 illustrates a spinneret plate 500 that includes a plurality of capillaries 502. FIG. 5 illustrates an end view of one capillary 502. As shown in FIG. 5, the capillary 502 includes a hexagonally shaped central area 504, an outer radial area 506 that is radially spaced apart from the hexagonally shaped central area 504, and legs 508*a*, 508*b*, 508*c* that extend between the outer radial area 506 and the hexagonally shaped central area 504. The capillary 502 defines three openings 510*a*, 510*b*, 510*c*, and each opening 510*a*, 510*b*, 510*c* is defined between the substantially hexagonal shaped central area 504, the outer radial area 506, and two adjacent legs 508*a*, 508*b*, 508*c*. Each opening 510*a*, 510*b*, 510*c* has a proximal end 512 adjacent the substantially hexagonal shaped central area 504 and a distal end 514 adjacent the outer radial area 506. The proximal end 512 has a greater width than the distal end 514 such that each opening 510*a*, 510*b*, 510*c* has a substantially triangular shape.

In addition, the proximal end 512 of each opening 510*a*, 510*b*, 510*c* has a geometric center 516 defined by an intersection of two adjacent sides of the substantially hexagonal shaped central area 504 adjacent the respective opening 510*a*, 510*b*, 510*c*.

The distal end 514 of each opening 510*a*, 510*b*, 510*c* has a rounded tip. For example, the rounded tip of each opening 510*a-c* may have a diameter $D_T$ of 0.16 mm. However, in other implementations, the tip may have a different diameter or be more pointed.

In the implementation shown in FIG. 5, the width $W_L$ of each leg 508*a*, 508*b*, 508*c* is 0.076 mm, the length $L_L$ of each leg 508*a*, 508*b*, 508*c* is 0.11 mm, the width $W_{AS}$ between outer ends of adjacent legs 508*a*, 508*b*, 508*c* is 0.67 mm, the distance $D_{CV}$ between the center 516 of the hexagonal area 504 and one of the vertices 518 of the hexagonal area 504 is 0.31 mm, the distance $D_{CL}$ between the center 516 and an outer end of one of the legs 508*a*, 508*b*, 508*c* is 0.34 mm, and the distance $D_{CT}$ between the center 516 and a proximal end 520 of a tip of one of the openings 510*a*, 510*b*, 510*c* is 1.05 mm. In addition, lines H-H extending through the distal end 514 of each opening 510*a*, 510*b*, 510*c* and the center 516 are 120° apart.

Figure 6:
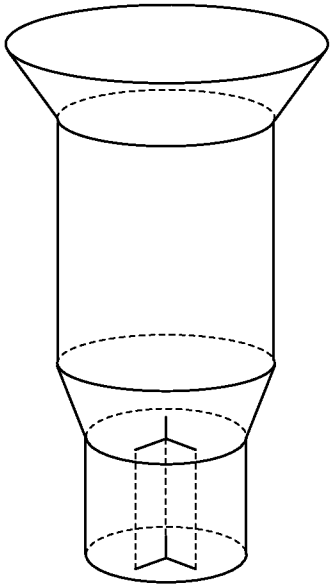
FIG. 6 illustrates a cross sectional view of the capillary in FIG. 5 taken along the G-G line.

FIG. 6 illustrates a cross sectional view of the capillary 502 shown in FIGS. 4 and 5 as viewed through the G-G line shown in FIG. 5. The capillary 502 is 6 mm deep, but in other implementations, this depth may be changed depending on the drawing speed and polymer being used.

The polymer exiting the end of the capillary 502 exits in three separate strands having the shape of the openings 510*a*, 510*b*, 510*c*, and each strand bulges radially outwardly such that the strands merge together, forming the intersection 117 of adjacent lobes 102, 104, 106 and the central portion 108 and void 110 of the filament 100 shown in FIG. 2.

In addition, the filament 100 may be a continuously drawn filament or may be a crimp and cut filament (e.g., to form staple fibers).

The terminology used herein is for the purpose of describing particular implementations only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While the foregoing description and drawings represent the preferred implementation of the present invention, it will be understood that various additions, modifications, combinations and/or substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. In addition, features described herein may be used singularly or in combination with other features. The presently disclosed implementations are, therefore, to be considered in all respects as illustrative and not restrictive, the scope of the invention being indicated by the appended claims and not limited to the foregoing description.

It will be appreciated by those skilled in the art that changes could be made to the implementations described above without departing from the broad inventive concept thereof. It is understood, therefore, that this invention is not limited to the particular implementations disclosed, but it is intended to cover modifications within the spirit and scope of the present invention, as defined by the following claims.

The invention claimed is:

1. A spinneret plate for producing filament, the spinneret plate comprising one or more capillaries, each capillary comprising a substantially hexagonal shaped central area, an outer radial area that is radially spaced apart from the substantially hexagonal shaped central area, and legs that extend between the outer radial area and the substantially hexagonal shaped central area, wherein the capillary defines three openings, each opening being defined between the substantially hexagonal shaped central area, the outer radial area, and two adjacent legs, wherein each opening has a proximal end adjacent the substantially hexagonal shaped central area and a rounded tip at a distal end adjacent the outer radial area, wherein the rounded tip has a proximal end that is a closest portion of the rounded tip to the substantially hexagonal shaped central area, and the proximal end of the opening has a greater width than the distal end such that each opening has a substantially triangular shape, and an outer side of each opening between the proximal end of the rounded tip at the distal end and the proximal end of the opening is substantially straight.

2. The spinneret plate of claim 1, wherein the proximal end of each opening has a geometric center defined by an intersection of two adjacent sides of the substantially hexagonal shaped central area adjacent the opening.

3. The spinneret plate of claim 2, wherein lines extending through the distal end of each opening and a center of the hexagonal shaped central area intersect at 120°.

4. The spinneret plate of claim 1, wherein lines extending through the distal end of each opening and a center of the hexagonal shaped central area intersect at 120°.

* * * * *